US008701544B2

(12) United States Patent
Peters et al.

(10) Patent No.: US 8,701,544 B2
(45) Date of Patent: Apr. 22, 2014

(54) FURNITURE PROVIDING BALLISTIC DEFENSE SHIELD

(75) Inventors: Fred E. Peters, Orange, CA (US); Jens Wemhoener, Aachen (DE)

(73) Assignee: Peters Security International, Inc., Orange, CA (US)

( * ) Notice: Subject to any disclaimer, the term of this patent is extended or adjusted under 35 U.S.C. 154(b) by 0 days.

(21) Appl. No.: 13/197,957

(22) Filed: Aug. 4, 2011

(65) Prior Publication Data

US 2012/0152096 A1 Jun. 21, 2012

Related U.S. Application Data

(60) Provisional application No. 61/400,966, filed on Aug. 5, 2010, provisional application No. 61/400,967, filed on Aug. 5, 2010.

(51) Int. Cl.
*F41H 5/02* (2006.01)

(52) U.S. Cl.
USPC ..... 89/918; 89/36.01; 89/36.02; 89/36.04; 89/914

(58) Field of Classification Search
USPC ..... 89/36.01, 36.02, 36.04, 901, 903, 914, 89/918, 920; 52/167.1
See application file for complete search history.

(56) References Cited

U.S. PATENT DOCUMENTS

| | | | | | |
|---|---|---|---|---|---|
| 4,048,365 | A * | 9/1977 | Hoover | 428/215 |
| 4,678,702 | A * | 7/1987 | Lancaster et al. | 428/193 |
| 5,180,880 | A * | 1/1993 | Zufle | 89/36.02 |
| 5,448,938 | A * | 9/1995 | Fernandez et al. | 89/36.02 |
| 5,603,140 | A * | 2/1997 | Pryce | 248/345.1 |
| 7,799,710 | B1 * | 9/2010 | Tan | 428/317.1 |
| 2007/0125012 | A1 * | 6/2007 | Quigley et al. | 52/167.1 |

* cited by examiner

*Primary Examiner* — Jonathan C Weber
(74) *Attorney, Agent, or Firm* — Procopio, Cory, Hargreaves & Savitch LLP; Noel C. Gillespie

(57) ABSTRACT

The present invention is directed to the initial construction of furniture having bullet-proof and/or bullet-resistant properties, and methods for manufacturing furniture providing ballistic defense shielding using soft armor and hard armor material components. Soft armor and hard armor require an area of flexibility or expansion to work effectively when struck by a projectile. If these materials are completely restricted their effectiveness is diminished. With the unique design of this application both the soft armor and hard armor are affixed to the interior and/or exterior surfaces of furniture allowing the flexibility or expansion required for maximum protection. The unique design may also be applied to retro-fit panels and/or frames comprising soft armor or hard armor material components to be attached to the exterior and/or interior surfaces of existing furniture.

11 Claims, 12 Drawing Sheets

FURNITURE PROVIDING BALLISTIC DEFENSE SHIELD

FIELD OF THE INVENTION

This application provides a unique construction or retrofitting of anti-ballistic furniture that is bullet-proof and/or bullet resistant in nature. More particularly, protective elements of the anti-ballistic furniture that will consist of layers of flexible anti-ballistic fabric (soft armor) layered in two directions attached in a unique fashion, alternatively, a second protective element of the anti-ballistic furniture will be constructed of pre-manufactured hard anti-ballistic armor components (hard armor).

BACKGROUND OF THE INVENTION

This application describes new and unique methods using the latest design of anti-ballistic protection available in the construction of a wide variety of furniture. Presently these materials are fabricated using not only Aramid fibers and KEVLAR® from DuPont, but also polyethylene fibers and GOLD SHIELD®, which is a KEVLAR® based material, and SPECTRA SHIELD®, which is a polyethylene based material, both available commercially from Honeywell. GOLD SHIELD® and SPECTRA SHIELD® are high strength synthetic fibers impregnated in partially cured resin for use in anti-ballistic material. Moreover, both of the Honeywell materials can be used as layered soft armor as well as in hard armor when they are autoclaved or compression molded into anti-ballistic components for construction of the anti-ballistic furniture, as shown and described. Other similar materials of like purpose and function are also anticipated by this disclosure.

Bullet proofing is the process of making something capable of stopping a bullet or similar high velocity projectiles e.g. shrapnel. The term bullet resistance is often preferred because few, if any, practical materials provide complete protection against all types of bullets, or multiple hits in the same location. Bullet designs vary widely, not only according to the particular firearm used (e.g. a 9×19 mm Parabellum caliber hollowpoint handgun cartridge will have inferior penetration power compared to a 7.62×39 mm assault rifle cartridge), but also within individual cartridge designs. As a result, whilst so-called "bullet-proof" panels may successfully prevent penetration by standard 7.62×39 mm bullets containing lead cores, the same panels may easily be defeated by 7.62×39 mm armor piercing bullets containing hardened steel penetrators.

Bullet-resistant materials, also called ballistic materials or, equivalently, anti-ballistic materials, are usually rigid, but may be supple. They may be complex, such as KEVLAR®, LEXAN®, and carbon fiber composite materials, or they may be basic and simple, such as steel or titanium. Bullet resistant materials are often used in law enforcement and military applications, to protect personnel from death or serious injuries.

With the advent of new materials and the improvement of manufacturing processes, items like ballistic-proof and/or ballistic-resistant furniture can become a practical item. It is well known that the construction of bullet-proof vests is done by applying multiple layers of fabric woven from an Aramid fiber together, which is sold by Du Pont under the Trade Mark KEVLAR, and has been done for many years. It can be used in a flexible state or laminated in a more rigid configuration. The success of the product is attained by multiple layers of the semi-impregnable flexible structure. This material combines high penetration resistance with lightness and flexibility but until presently no one has endeavored to manufacture items like furniture of this material.

There is a growing need for methods of self protection in an increasingly wide variety of locations. In the modern world, crimes and attacks committed by persons with guns are an ever more common occurrence. In the past, police personnel and military personnel have been the primary targets of gunfire which has been directed toward them during work or duty. Because of this continual risk of harm, bullet resistant vests and shields have been developed which may be deployed or worn on the user's body as a protective component of their work attire. Such devices, when employed for protection against weapons fire have worked fairly well in preventing a high velocity bullet or shell from penetrating the wearer's body since the velocity is slowed considerably. But increasingly, civilians are a target for shooting attacks.

Mass shootings receive a great deal of coverage in the media, as we saw with the Orlando, Fla., office shootings in November 2009 and in the shootings at the manufacturing plant in Albuquerque, N. Mex., in July 2010. Out of 421 workplace shootings recorded in 2008 (8% of total fatal injuries), 99 (24%) occurred in retail trade. Workplace shootings in manufacturing were less common, with 17 shootings reported in 2008. Workplace shooting events account for only a small portion of nonfatal workplace injuries. Over the past 5 years, 2004-08, an average of 564 work-related homicides occurred each year in the United States. In 2008, a total of 526 workplace homicides occurred, or 10 percent of all fatal work injuries. About 4 out of every 5 homicide victims in 2008 were male. The type of assailants in these cases differed for men and women. Robbers and other assailants made up to 72% of assailants for men, and 51% of assailants for women. Relatives and other personal acquaintances accounts for only 4% of assailants of homicides for men, but 28% for women. In 2008 there were 30 multiple-fatality workplace homicide incidents, accounting for 67 homicides and 7 suicides. On Average, about two people died in each of these incidents. Shootings accounted for 80 percent of all homicides in 2008 (421 fatal injuries). Co-workers and former co-workers were the assailants in 12% of all shootings. Robbers were the assailants in another 40% of cases in 2008 (421 fatal injuries) occurred in public buildings, thereby endangering bystanders. Sales and related occupations accounted for 26% of decedents in shootings. Most shootings occurred in the private sector (86%) whereas 14% of shootings occurred in government, and of the shootings within the private sector, 88% occurred within service-providing industries, mostly in trade, transportation, and utilities.

A brief rundown of some fatal workplace and school shootings across the United States, includes as follows:

- Aug. 3, 2010: Warehouse driver Omar Thornton shot and killed eight people before apparently committing suicide at a Manchester, Conn., beer distributorship;
- Feb. 12, 2010: Three biology professors were shot and killed and three other employees injured at the University of Alabama's Huntsville campus. Amy Bishop, a 42-year-old instructor and researcher at the school, is charged with murder;
- Nov. 5, 2009: At Fort Hood, Tex., 13 people were fatally shot and 32 were injured. Army psychiatrist Maj. Nidal Malik Hasan, 39, is charged with 13 counts of premeditated murder;
- Jun. 25, 2008: Wesley N. Higdon, 25, killed five workers, then himself, at Atlantis Plastics in Henderson, Ky. A sixth shooting victim survived;

Mar. 18, 2008: Lee Isaac Bedwell Leeds, 31, shot and killed four men at a junk yard in Santa Maria, Calif.;

Mar. 12, 2008: Robert Lanham killed two people in the Regions Bank of McComb, Miss., where his ex-wife, then forced the woman to flee with him before killing her and committing suicide;

Sep. 23, 2008—Stephen Kazmierczak, 27, opens fire in a crowded lecture hall at Northern Illinois University, killing five students and injuring 18 others before committing suicide;

Apr. 16, 2007—Student Cho Seung-hui, 23, fatally shoots 32 people at Virginia Tech University in Blacksburg, then kills himself in the deadliest gun rampage in U.S. history;

Jan. 30, 2006: Former postal worker Jennifer San Marco, 44, shot and killed six postal employees, then herself, in Goleta, Calif.; and Jul. 2, 2004: Elijah Brown, 21, killed four co-workers and wounded three others at ConAgra Foods meatpacking plant in Kansas City, Kans., before committing suicide.

There are numerous other reports of school shootings around the world, such as:

Apr. 7, 2011—Wellington Menenzes Oliveira, 24, opens fire inside the Tasso da Silveira school in Realengo near Rio de Janeiro, Brazil, killing 12 people before taking his own life. Oliveira is believed to be a former student;

Nov. 7, 2007—Eighteen-year-old Pekka-Eric Auvinen kills seven fellow students and a teacher at Jokela High School in Tuusula, Finland before shooting himself.

Nov. 20, 2006—Expelled student Sebastian Bosse, 18, kills 14 teachers, two students and a policeman during a gun rampage at his former high school in Emadetten, Germany. He then takes his own life.

It has been made clearly evident by the shooting at Fort Hood that additional means of self protection has become very necessary. The mass shooting took place on Nov. 5, 2009, at Fort Hood, the most populous U.S. military installation in the world, located just outside Killeen, Tex. In the course of the shooting, a single gunman killed 13 people and wounded 29 others. According to witnesses, Army reserve Captain John Gaffaney attempted to stop Hasan, either by charging him or throwing a chair at him, but was mortally wounded in the process. Civilian physician assistant Michael Cahill also tried to charge Hasan with a chair before being shot and killed. Army reserve Specialist Logan Burnette tried to stop Hasan by throwing a folding table at him, but he was shot in the left hip, fell down, and crawled to a nearby cubicle. There were work tables present which could have provided some protection had they been constructed with bullet resistant materials.

It was additionally made evident at Columbine High School in Colorado in 1999 that similar occurrences may again take place at other locations where civilians, including children are affected, and therefore there is an increased need for self-protection in these places. With the introduction of a ballistic-proof and/or ballistic-resistant furniture, such devices can blend into a conventional room's appearance where people gather such as meeting rooms, classrooms, libraries, cafeterias, governmental chambers, council rooms, school board chambers and can thereby keep from making a room where people gather for social, educational or governmental purposes appear like a military bunker.

Consequently, there exists a need for a method which will give anti-ballistic protection to a wide variety of furniture. It has been found through the endeavors of the inventor and the patent search that there is no method on the market and no apparent patents reviewed that have similar characteristics to the unique methods of creating furniture providing ballistic defense shielding.

Numerous innovations for bullet proof protection have been provided in the prior art that art described as follows. Even though these innovations may be suitable for the specific individual purposes to which they address, they differ from the present invention as hereinafter contrasted. The following is a summary of those prior art patents most relevant to the invention at hand, as well as a description outlining the difference between the features of the present invention and those of the prior art.

U.S. Pat. No. 5,392,686 of Wilfred A. Sankar describes a protective shield, comprising a frame. The frame having a frame top, a frame bottom, frame sides, and frame upper sides between the frame sides and frame top. The shield further having a front panel and a back panel, each made from a bullet-proof plastic fabric such as KEVLAR. The shield has a viewing window, made of a transparent bullet-proof material, such as LEXAN. A shield inner channel is mounted between the front panel and back panel. A first extension is mounted within the shield inner channel that slidably extends from the shield bottom for use, and retracts for storage.

This patent describes a protective shield and it's construction only and does not endeavor to make any reference to using the improved soft armor or hard armor along with the design in the construction of a wide range of furniture.

U.S. Pat. No. 4,625,659 of Henrich Saelzer describes a bullet and explosion-proof security structure such as a window or door for closing an opening in the wall of a building or the like that has two plate-like panels which are enclosed in respective frames so located that the panels extend in parallel to each other and enclose a chamber or space between them. The frames are arranged within a soffit surrounding the opening, whereby the outer frame is spaced from the soffit to form a gap between the frame and the soffit for providing a ventilating channel. In order to prevent projectiles from entering through the ventilation gap from the outside of the building into a room in the building, the frames are covered on their sides facing each other by security members that are made of bullet-proof material, for example, steel. The securing members extend to cover critical areas of the frames and panel edges near the venting gap and overlap, at least partially, each other.

This patent describes a bullet and explosion-proof security structure such as a window or door for closing an opening in the wall of a building and the detailed method of its construction but does not indicate the possibility of using the process for furniture or indicate the unique Furniture Providing Ballistic Defense Shielding of this application with the use of soft armor or hard armor.

None of the previous efforts, however, provides the benefits attendant with the present. The present methods of manufacturing Furniture Providing Ballistic Defense Shielding achieves its intended purposes, objects and advantages over the prior art devices through a new, useful and unobvious combination of method steps and component elements, at a reasonable cost to manufacture, and by employing readily available materials. Additionally, at least for small school or workplace tables, these items may be held in place or moved in place between the shooter and potential target victims.

In this respect, before explaining at least one embodiment of the methods of manufacturing Furniture Providing Ballistic Defense Shielding in detail it is to be understood that the design is not limited in its application to the details of construction and to the arrangement, of the components set forth in the following description or illustrated in the drawings. The method of manufacturing Furniture Providing Ballistic Defense Shielding is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage is the unique methods of manufacturing Furniture Providing Ballistic Defense Shielding.

Another advantage is to supply a wide range of conventionally appearing furniture that has the capability of offering anti-ballistic protection.

Another advantage of the Furniture Providing Ballistic Defense Shielding is that people can crouch behind it in a defensive position, and in some lightweight configurations people under attack can hold it, move it or carry it with them while moving.

Another advantage of Furniture Providing Ballistic Defense Shielding is to supply a wide range of furniture items that can be relatively inexpensive to manufacture and/or retrofit.

Another advantage is to supply Furniture Providing Ballistic Defense Shielding fabricated of a variety of materials including multiple layers of soft fabric woven material from an Aramid fiber which is sold by Du Pont under the registered trademark KEVLAR® and will resist and absorb the impact of a bullet and referred to in this application as soft armor.

Another advantage is to supply Furniture Providing Ballistic Defense Shielding fabricated of multiple layers of resin impregnated fabric of Aramid fiber creating a hard anti-ballistic material that will resist and absorb the impact of a bullet and referred to in this application as hard armor.

Another advantage of the Furniture Providing Ballistic Defense Shielding is that it can have a wide range of applications including military, governmental, schools, business offices and private usage.

Another advantage of the two methods of manufacturing Furniture Providing Ballistic Defense Shielding is that they can be used to create a retro-fit panel to be used on furniture.

And a further advantage of the Furniture Providing Ballistic Defense Shielding is that it may prevent perpetrators from carrying out acts of violence when it is known that anti-ballistic furniture is in use within a facility.

The foregoing has outlined some of the more pertinent advantages of the methods of manufacturing Furniture Providing Ballistic Defense Shielding. These advantages should be construed to be merely illustrative of some of the more prominent features and applications of the intended methods of manufacturing Furniture Providing Ballistic Defense Shielding. Many other beneficial results can be attained by applying the disclosed methods of manufacturing Furniture Providing Ballistic Defense Shielding in a different manner or by modifying the invention within the scope of the disclosure. Accordingly, other advantages and a fuller understanding of the methods of manufacturing Furniture Providing Ballistic Defense Shielding may be had by referring to the summary of this application and the detailed description of the preferred embodiment in addition to the scope of the methods of manufacturing Furniture Providing Ballistic Defense Shielding defined by the claims taken in conjunction with the accompanying drawings.

The two methods of manufacturing Furniture Providing Ballistic Defense Shielding make use of materials that are fabricated using not only Aramid fibers and KEVLAR® from DuPont, but also polyethylene fibers and GOLD SHIELD®, which is a KEVLAR® based material, and SPECTRA SHIELD®, which is polyethylene based material, both available commercially from Honeywell. GOLD SHIELD® and SPECTRA SHIELD® that are high strength synthetic fibers impregnated in partially cured resin for use in anti-ballistic material. Moreover, both of the Honeywell materials can additionally be used as layered soft armor as well as in hard armor when they are autoclaved or compression molded into anti-ballistic components for construction of the anti-ballistic furniture. This material combines high penetration resistance with lightness of weight.

Soft armor and hard armor require an area of flexibility or expansion to work effectively when struck by a projectile. If these materials are completely restricted their effectiveness is diminished. With the unique design of this application both the soft armor and hard armor are affixed to the inner surfaces of the furniture allowing the flexibility or expansion required for maximum protection and the natural look of the furniture. Using these methods of manufacturing a wide range of furniture may be constructed including but not limited to basic tables, folding tables, computer tables, office desks, podiums, student desks and governmental benches.

The unique design may also be applied to retro-fit panels using soft armor or hard armor to be attached to the inner surface of a defense shield frame and installed on the exterior and/or interior surfaces of the furniture. The retro-fit panels use a unique defense shield frame that creates the air space required between the panel frame and the furniture material for the required flexibility in the soft armor or the expansion of the hard armor within when hit by a bullet or any other projectile. The retro-fit panels will still have the natural appearance of the furniture while supplying the benefits of the Furniture Providing Ballistic Defense Shielding.

It must be understood at this time that a variety of other materials such as some metals and plastics can offer a means of providing ballistic defense for furniture especially if used by the methods disclosed where they are allowed the flexibility or, expansion to absorb the initial shock of being hit by a bullet or any other projectile. These methods must be considered within the scope of this application. The limiting utility factor of these materials is their weight and that is where the use of the soft armor and hard armor of this application are beneficial.

With respect to the above description then, it is to be realized that the optimum dimensional relationships of the methods of manufacturing Furniture Providing Ballistic Defense Shielding, to include variations in size, materials, shape, form, function and manner of assembly and use, are deemed readily apparent and obvious to one skilled in the art, and all equivalent relationships to those illustrated in the drawings and described in the specification are intended to be encompassed by the present methods of manufacturing Furniture Providing Ballistic Defense Shielding. Therefore, the foregoing is considered as illustrative only of the principles of this application. Further, since numerous modifications and changes will readily occur to those skilled in the art, it is not desired to limit the methods of manufacturing Furniture Providing Ballistic Defense Shielding to the exact construction and operation shown and described, and accordingly, all suitable modifications and equivalents may be resorted to falling within the scope of this application.

BRIEF DESCRIPTION OF THE DRAWINGS

The accompanying drawings, which are incorporated in and form a part of this specification, illustrate embodiments of the methods of manufacturing Furniture Providing Ballistic Defense Shielding and together with the description, serve to explain the principles of this application.

DETAILED DESCRIPTION OF THE PREFERRED EMBODIMENTS

As required, detailed embodiments of the present methods of manufacturing Furniture Providing Ballistic Defense Shielding are disclosed herein, however, it is to be understood that the disclosed embodiments are merely exemplary of the methods of manufacturing Furniture Providing Ballistic Defense Shielding that may be embodied in various forms. Therefore, specific functional and structural details disclosed herein are not to be interpreted as limiting, but merely as basis for the claims and as a representative basis for teaching one skilled in the art to variously employ the present design in virtually any appropriately detailed structure.

Figure 1:
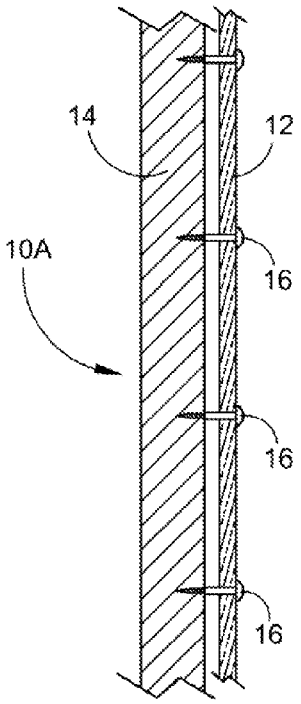
FIG. 1 depicts a cross section of a segment of the methods of manufacturing Furniture Providing Ballistic Defense Shielding by using a means of multiple attachment points of the soft armor.

Referring now to the drawings, wherein similar parts of the methods of manufacturing Furniture Providing Ballistic Defense Shielding 10A and 10B are cross sections of a segments of furniture using the methods involved. FIG. 1 depicts the first method of manufacturing Furniture Providing Ballistic Defense Shielding 10A which employs the use of multiple attachment points for a means of securing the soft armor 12 to the internal structural material 14 of the furniture, by an attachment means such as shoulder screws or shoulder bolts 16, where the soft armor 12 is not held tightly against the structural material 14 (for example the wood in a wooden table or desk, etc.) and has the ability to flex when hit by a projectile.

Figure 2:
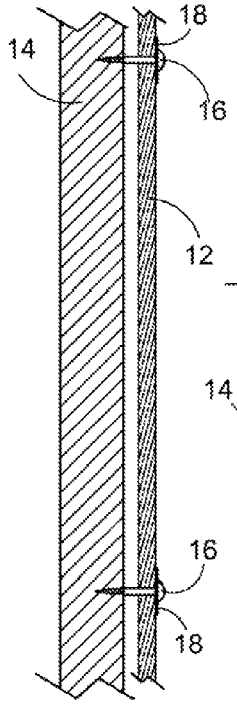
FIG. 2 depicts a cross section of a segment of the methods of manufacturing Furniture Providing Ballistic Defense Shielding by using a means of wider spacing of the attachment points of the soft armor means.

FIG. 2 depicts a cross section of a segment of furniture illustrating the method of manufacturing Furniture Providing Ballistic Defense Shielding 10A having a wider spacing of the attachment points of the soft armor 12 by using shoulder screws or bolts 16 with flexible plastic fender washers 18, allowing greater holding capability with the wider spacing.

Figure 3:
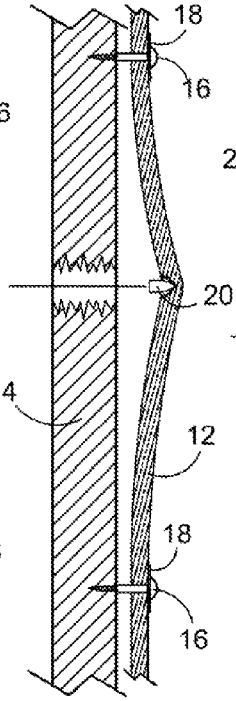
FIG. 3 depicts a cross section of a segment of the methods of manufacturing Furniture Providing Ballistic Defense Shielding illustrating a bullet penetrating the external furniture structure and being stopped by the means of the flexibility in the soft armor.

FIG. 3 depicts a cross section of a segment of furniture by using the method of manufacturing Furniture Providing Ballistic Defense Shielding 10A illustrating a bullet 20 penetrating the external furniture material 14 and being stopped by the means of the flexibility in the soft armor 12.

Figure 4:
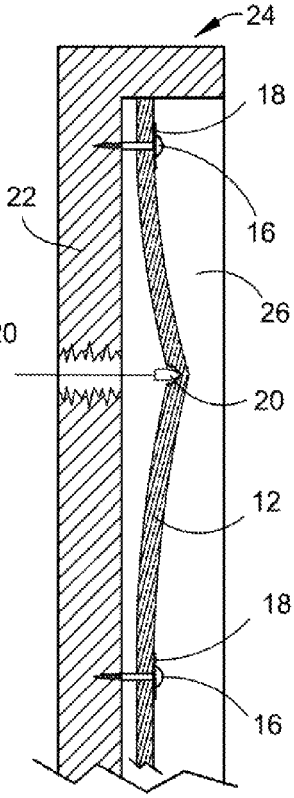
FIG. 4 depicts a cross section of a segment of the methods of manufacturing Furniture Providing Ballistic Defense Shielding illustrating a bullet penetrating the external surface of the retro-fit panel and being stopped by the flexible means of the soft armor.

FIG. 4 depicts a cross section of a segment of the method of manufacturing Furniture Providing Ballistic Defense Shielding 10A illustrating a bullet 20 penetrating the external surface of the retro-fit panel 22 and being stopped by the means of the flexibility in the soft armor 12. The defense shield frame 24 creates the air space 26 required for the flexibility in the soft armor 12 when hit by a bullet 20 or any other projectile.

Figure 5:
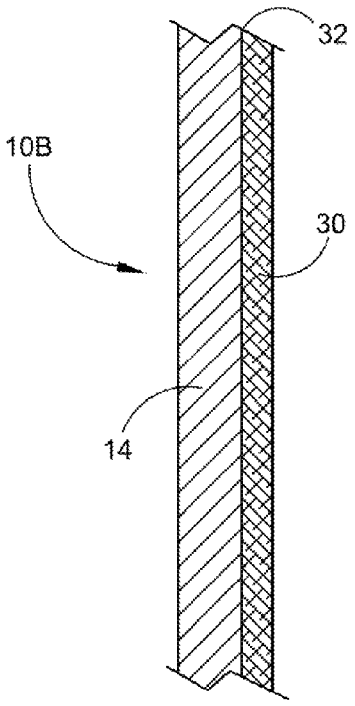
FIG. 5 depicts a cross section of a segment of the methods of manufacturing Furniture Providing Ballistic Defense Shielding using hard armor fixably attached to the inner structure of the furniture.

FIG. 5 Illustrates a cross section of a segment of the method of manufacturing Furniture Providing Ballistic Defense Shielding 10B using hard armor 30 fixably attached to the inner surface of the furniture material 14 by an adhesive means 32.

Figure 6:
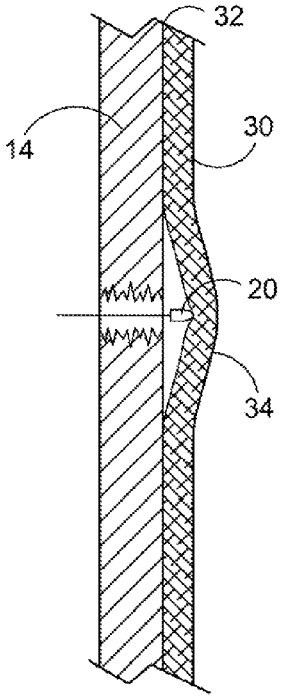
FIG. 6 depicts a cross section of a segment of the methods of manufacturing Furniture Providing Ballistic Defense Shielding using hard armor fixably attached to the internal surface of the furniture where the bullet has penetrated the structure but is stopped by the means of the hard armor.

FIG. 6 depicts a cross section of a segment of the method of manufacturing Furniture Providing Ballistic Defense Shielding 10B using hard armor 30 fixably attached to the inner surface of the furniture material 14 by an adhesive means 32 where the bullet 20 has penetrated the structure of the furniture material 14 but the hard armor 30 has been deformed 34, but has stopped the bullet 20.

Figure 7:
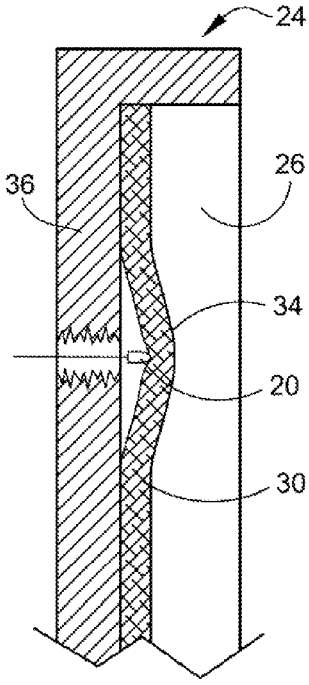
FIG. 7 depicts a cross section of a segment of the methods of manufacturing Furniture Providing Ballistic Defense Shielding using hard armor fixably attached to the inner surface of a retro-fit panel where the bullet has penetrated the structure of the but is stopped by the means of the hard armor.

FIG. 7 depicts a cross section of a segment of the method of manufacturing Furniture Providing Ballistic Defense Shielding 10B using hard armor 30 fixably attached to the inner surface of the retro-fit panel 36 illustrating where the bullet 20 has penetrated the external material of the retro-fit panel 36 but is stopped by the means of the hard armor 30.

Figure 8:
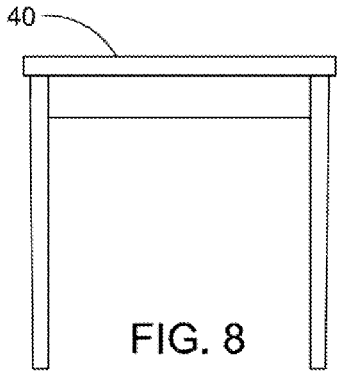
FIG. 8 depicts an end view of a conventional table.

FIG. 8 depicts an end view of a conventional table 40.

Figure 9:
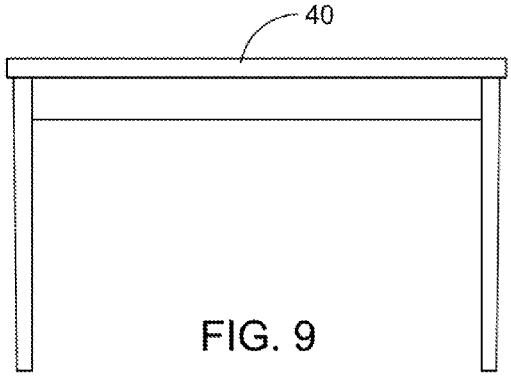
FIG. 9 depicts a side view of a conventional table.

FIG. 9 depicts a side view of a conventional table 40.

Figure 10:
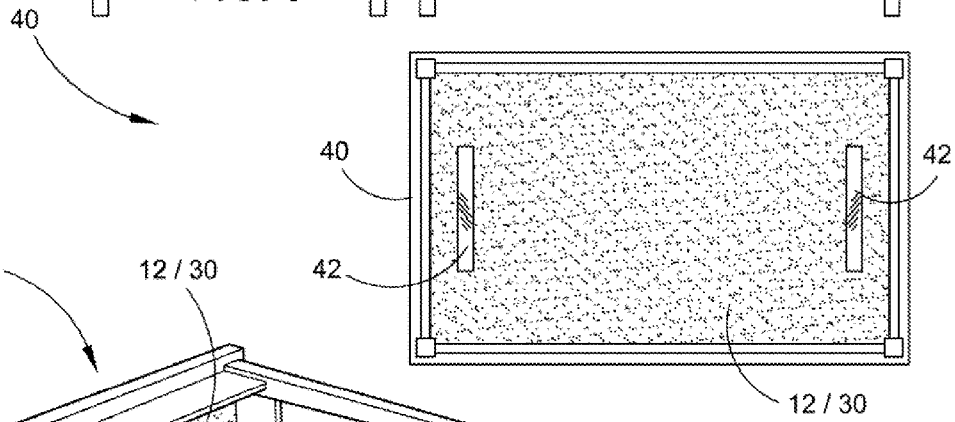
FIG. 10 depicts a bottom view of the conventional table with the installation of the Ballistic Defense Shielding.

FIG. 10 depicts a bottom view of the conventional table 40 with the installation of the option of Ballistic Defense Shielding consisting of soft armor 12 or hard armor 30. One or more optional view ports 42 can be located at one or both ends of the table 40.

Figure 11:
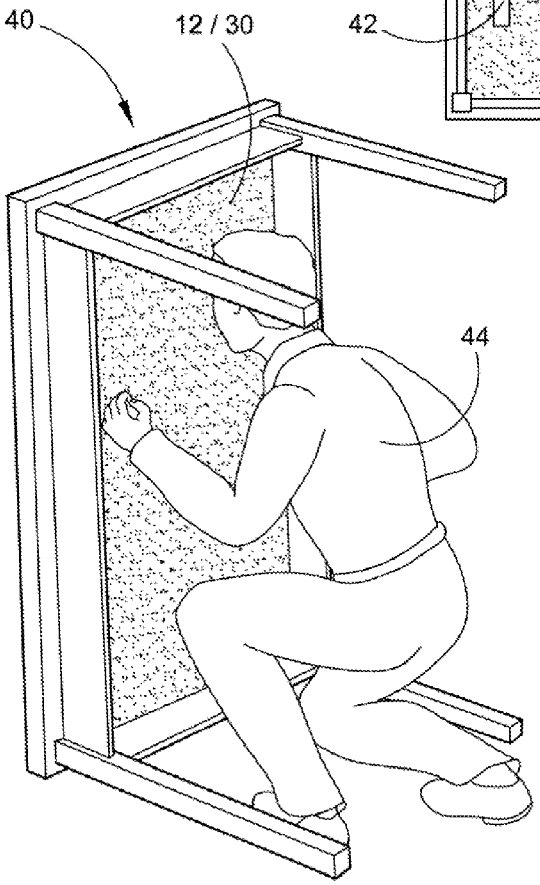
FIG. 11 depicts a person using the table tipped on its end having the Ballistic Defense Shielding.

FIG. 11 depicts a person 44 kneeling behind the conventional table 40 tipped on its end using the Ballistic Defense Shielding consisting of soft armor 12 or hard armor 30.

Figure 12:
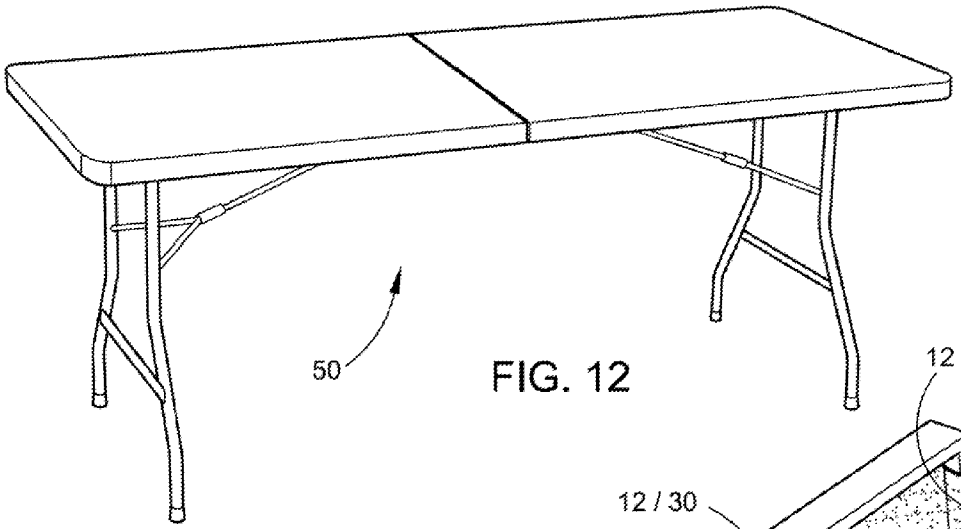
FIG. 12 depicts a perspective view of a typical folding table.

FIG. 12 depicts a perspective view of a typical folding table 50.

Figure 13:
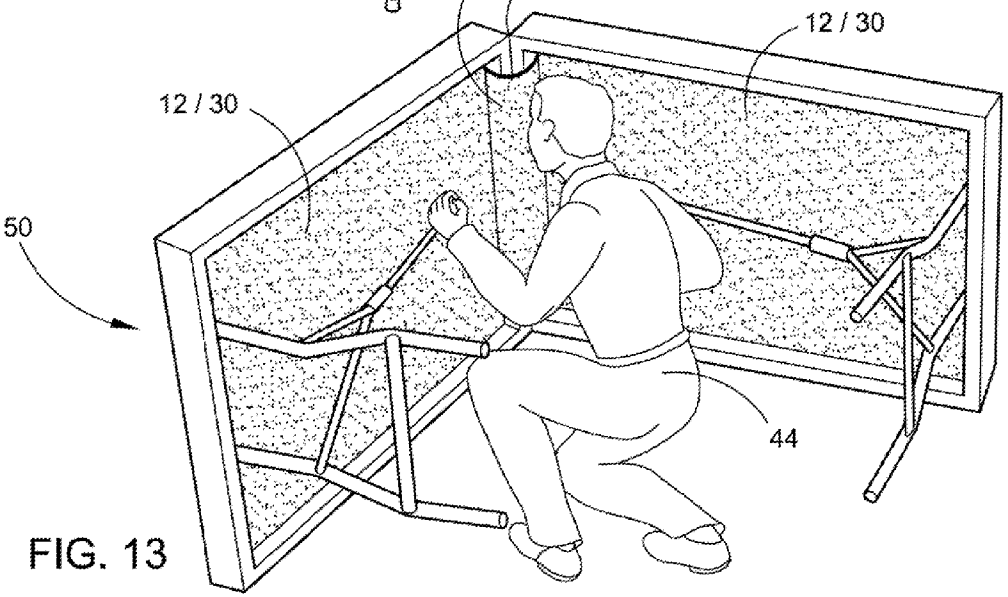
FIG. 13 depicts a person kneeling for protection behind the folding table on its side with the installation of the Ballistic Defense Shielding.

FIG. 13 depicts a person 44 kneeling for protection behind the folding table 50 on its side with the installation of the Ballistic Defense Shielding consisting of soft armor 12 or hard armor 30 with the flexibility of the soft armor 12 used in the area of the folding table hinge 52.

Figure 14:
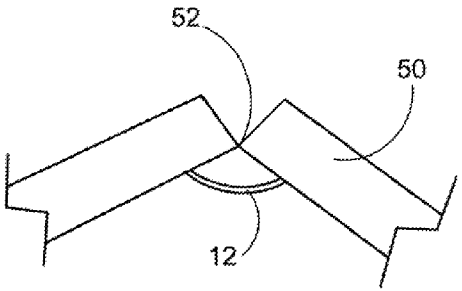
FIG. 14 depicts a detail of the hinge section of the folding table with the soft armor providing the protection for the hinge area of the table.

FIG. 14 depicts a detail of the hinge section of the folding table 50 with the flexible soft armor 12 providing the protection for the folding table hinge 52.

Figure 15:
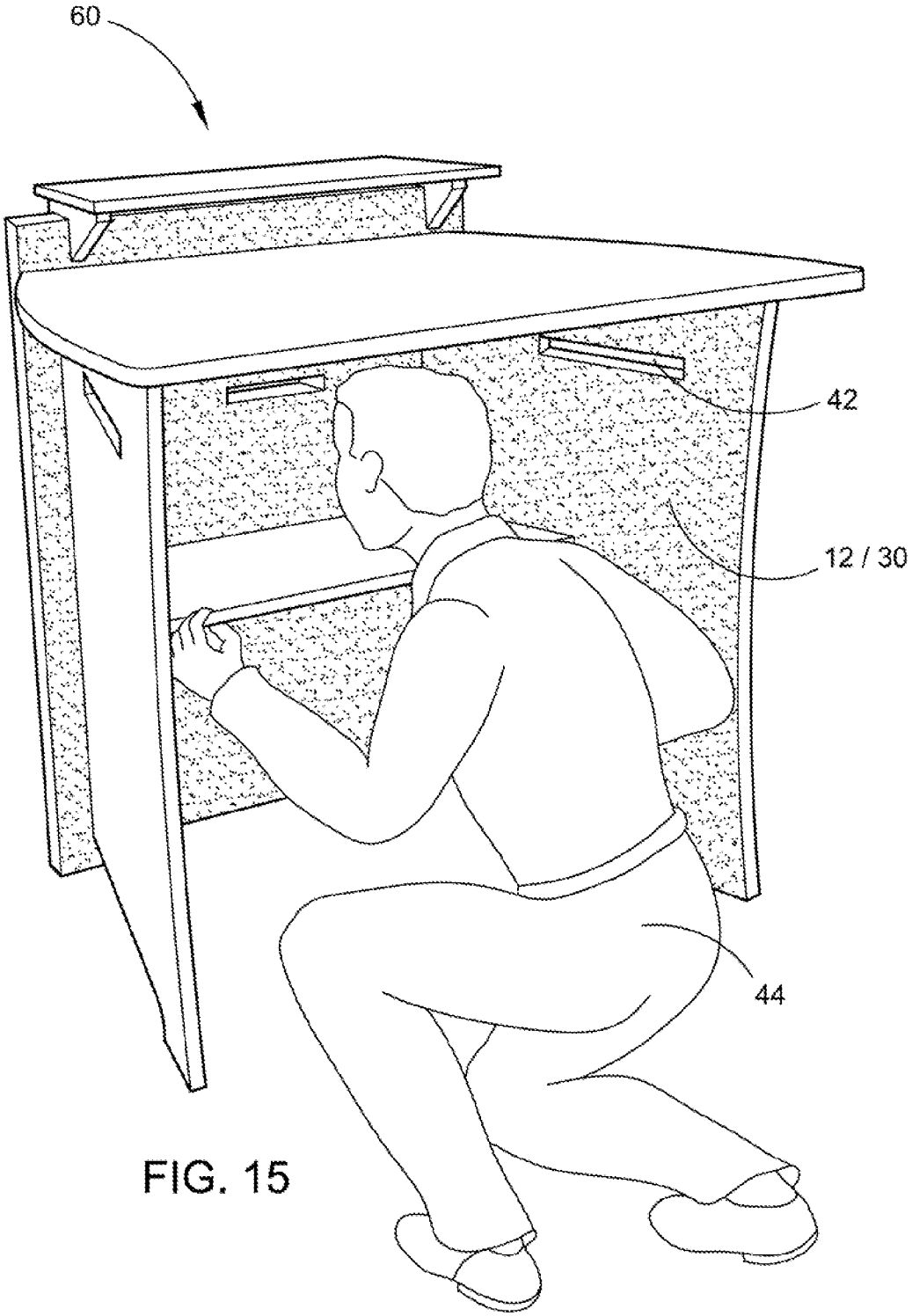
FIG. 15 depicts a person kneeling behind a computer style of desk having internal Ballistic Defense Shielding.

FIG. 15 depicts a person 44 kneeling behind a computer style of desk 60 having internal Ballistic Defense Shielding consisting of soft armor 12 or hard armor 30. These types of computer desks 60 can vary widely in size, shape and configuration, but with the incorporation of the Ballistic Defense Shielding consisting of soft armor 12 or hard armor 30 will fall within the scope of this application.

Figure 16:
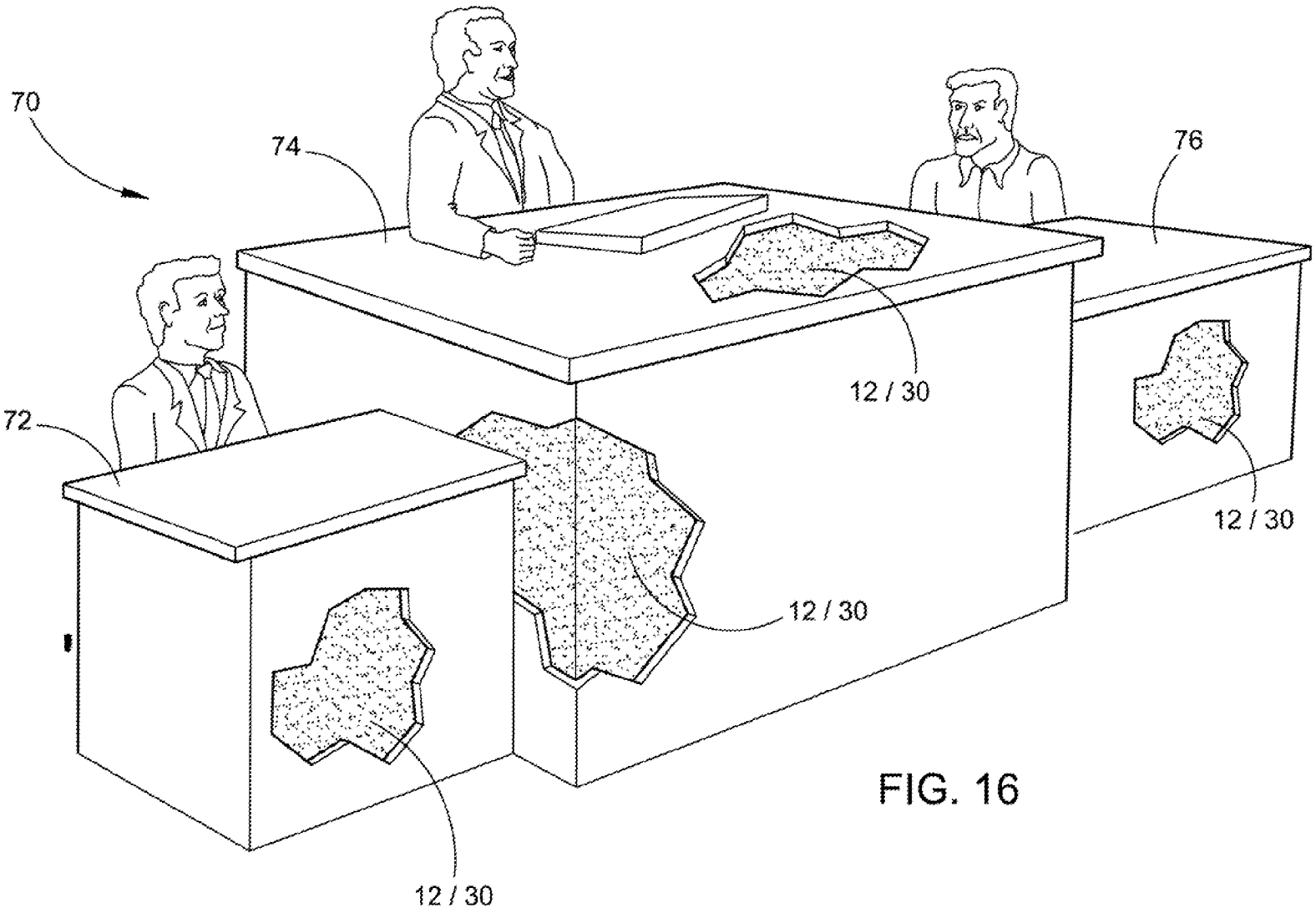
FIG. 16 depicts a governmental style of bench configuration having Ballistic Defense Shielding.

FIG. 16 depicts a governmental style of bench configuration 70 consisting of the witness stand 72, the judge's bench 74 and the clerks table 76, all having Ballistic Defense Shielding consisting of soft armor 12 or hard armor 30.

Figure 17:
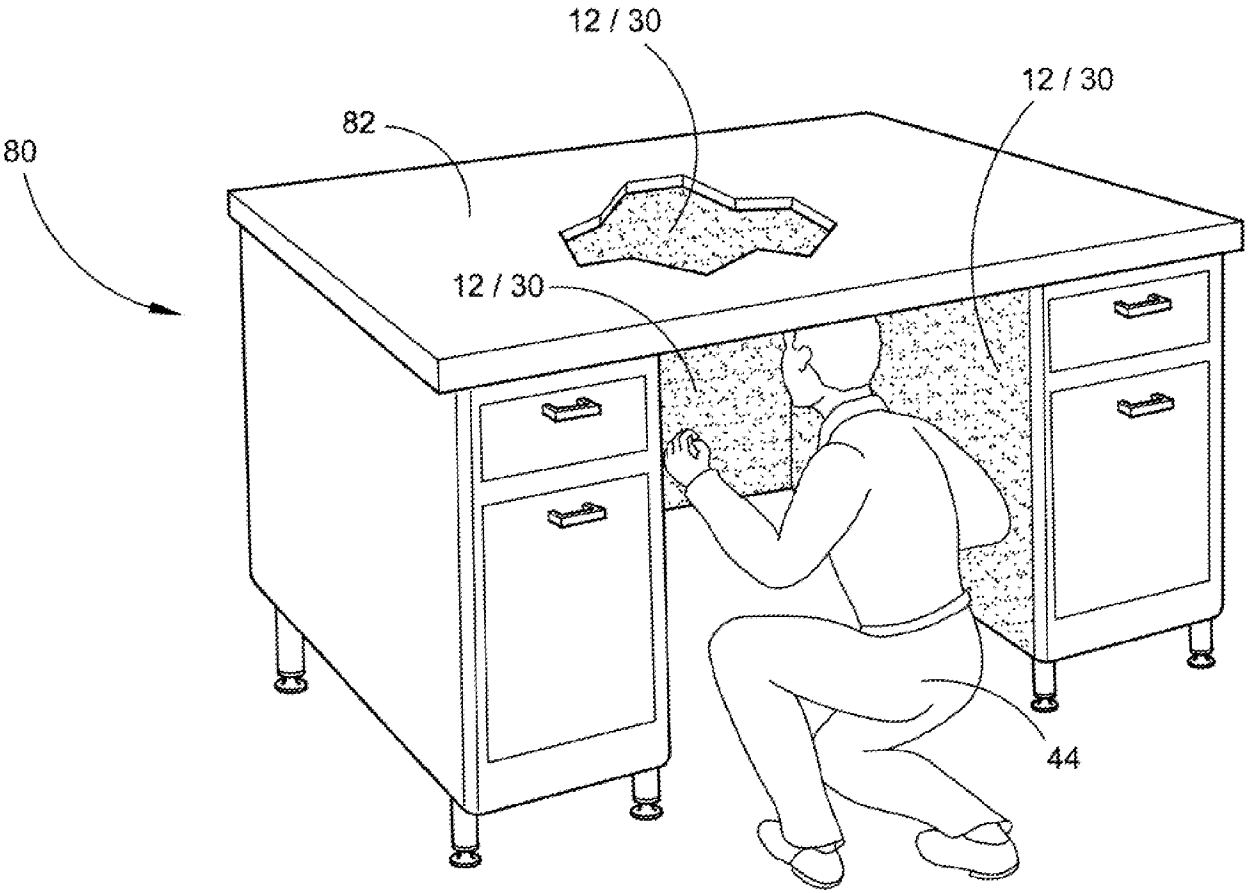
FIG. 17 depicts a person kneeling behind an office style of desk with internal Ballistic Defense Shielding.

FIG. 17 depicts a person 44 kneeling behind an office style of desk 80 with the incorporation of the internal Ballistic Defense Shielding consisting of soft armor 12 or hard armor 30 including under the desk upper surface 82 of the desk 80.

Figure 18:
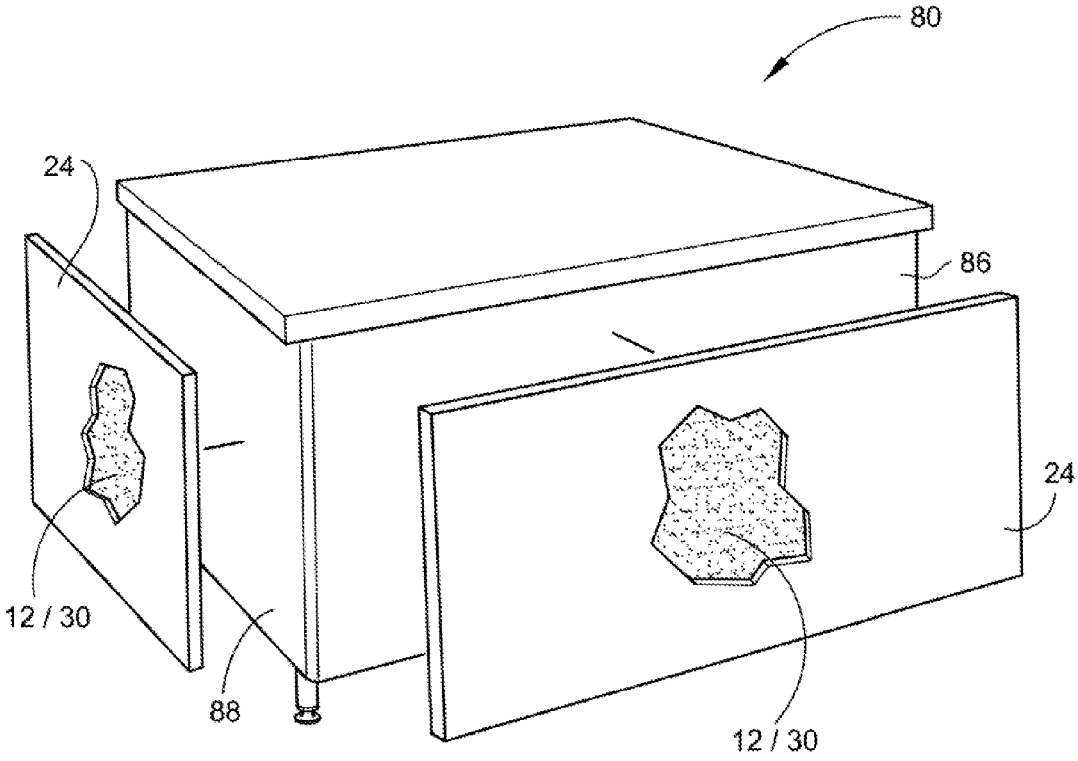
FIG. 18 depicts an office style of desk with external retro-fit Ballistic Defense Shielding attached to the front and sides.

FIG. 18 depicts an office style of desk 80 with external retro-fit Ballistic Defense Shielding frames 24 exploded away from the desk 80 having soft armor 12 or hard armor 30 to be attached to the desk front 86 and desk sides 88. It should be understood that the retrofit frames and/or panels may be installed on the exterior or interior surfaces of the conventional furniture. It should also be understood that any of the surfaces desired to be retrofitted to be bullet-proof and/or bullet resistant may have frames and/or panels attached to them. This includes the top surface, side surfaces and front or rear surfaces.

Figure 19:
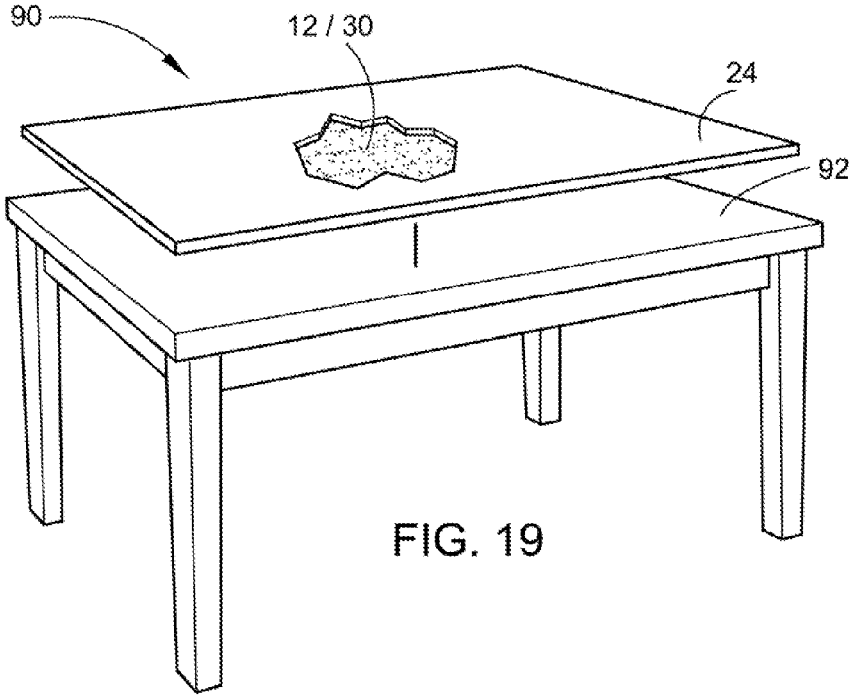
FIG. 19 depicts a conventional table with retro-fit Ballistic Defense Shielding attached to the top surface.

FIG. 19 depicts a conventional table 90 with retro-fit Ballistic Defense Shielding frame 24 exploded away from the table having soft armor 12 or hard armor 30 to be attached to the table top surface 92.

Figure 20:
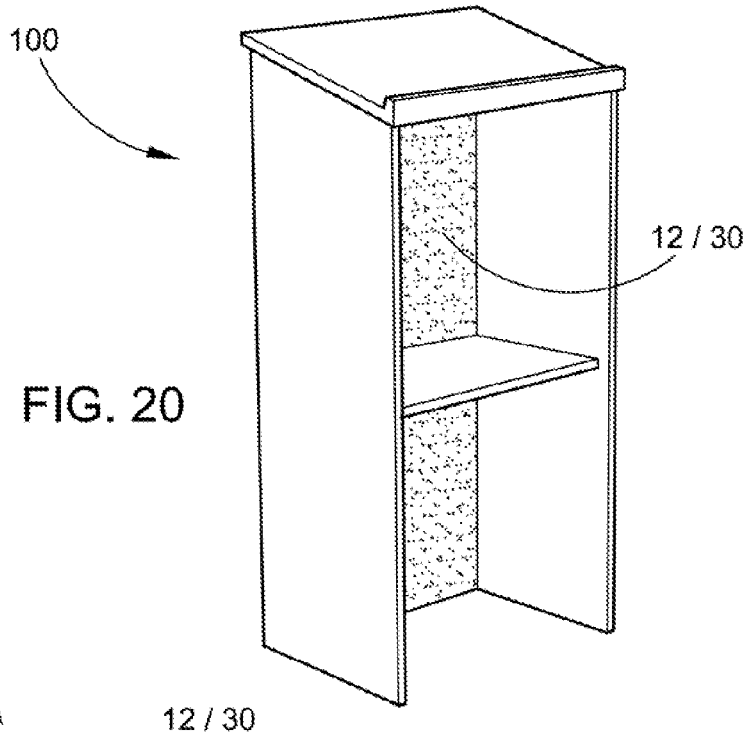
FIG. 20 depicts a conventional podium with internal Ballistic Defense Shielding.

FIG. 20 depicts a conventional podium 100 with internal Ballistic Defense Shielding consisting of soft armor 12 or hard armor 30.

Figure 21:
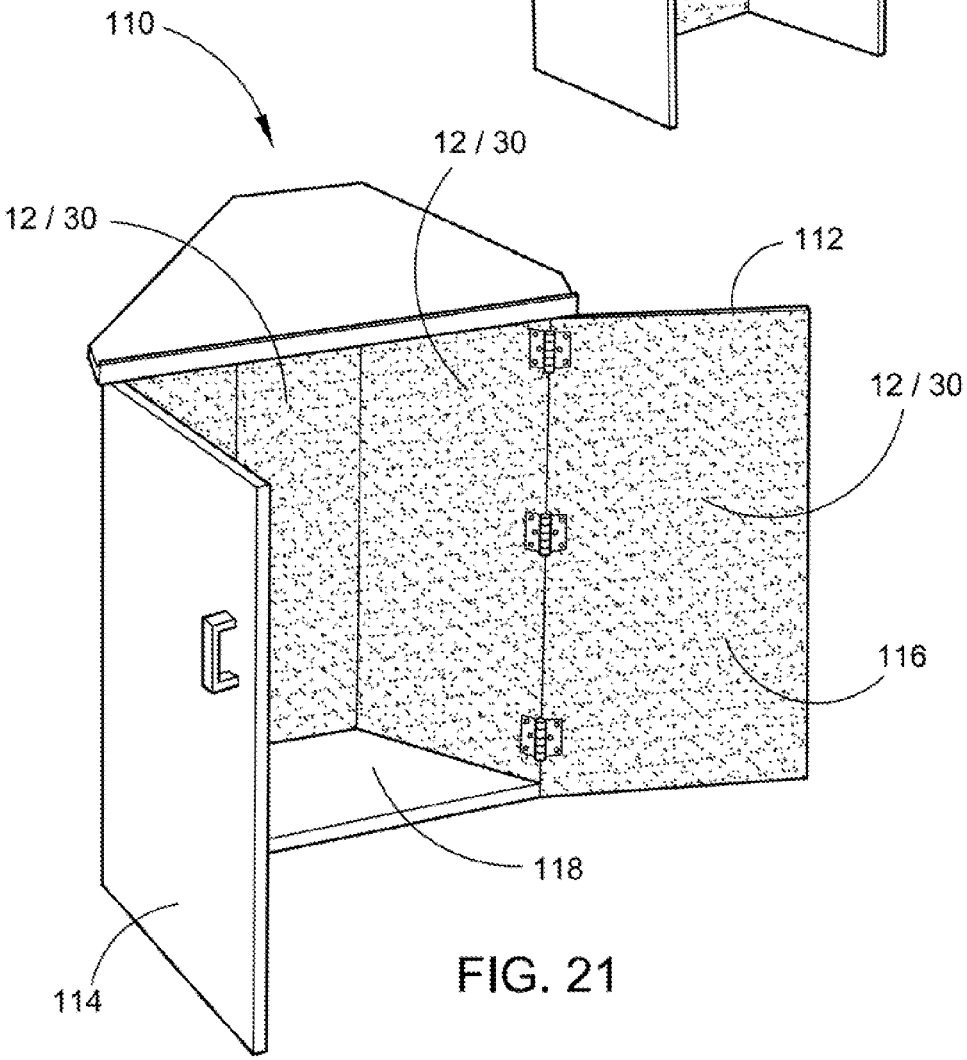
FIG. 21 depicts an elaborate podium with extending doors having internal Ballistic Defense Shielding.

FIG. 21 depicts an elaborate podium 110 with extending doors 112 and 114 having internal Ballistic Defense Shielding consisting of soft armor 12 or hard armor 30 on the surfaces 116 of the internal cavity 118 along with the inside of the doors 112 and 114. The doors 112 and 114 can be kept closed as a cabinet or opened wide to add additional protection. It should be understood that any conventional piece of furniture could also be made with a fourth surface panel rendering the furniture completely bullet-proof and/or bullet resistant, whereby the potential shooting victim can get inside and close the fourth panel. In the case of podium 110, the doors 112 and 114 could be closed in this fashion, protecting the potential victim from all sides. This fourth anti-ballistic panel/frame could also be in the form of a table leaf or other similar component integrated into the piece of furniture, to provide four sided bullet-proof and/or bullet-resistant protection.

Figure 22:
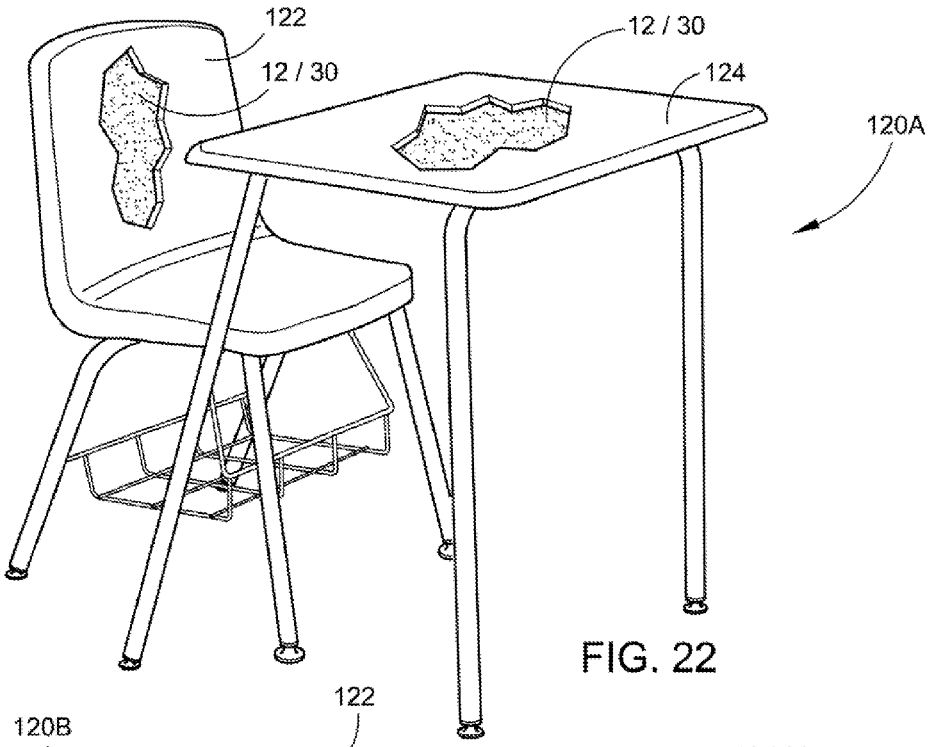
FIG. 22 depicts a school desk with separate chair having Ballistic Defense Shielding.

FIG. 22 depicts a school desk 120A with separate chair 122 and desk top 124 having Ballistic Defense Shielding consisting of soft armor 12 or hard armor 30.

Figure 23:
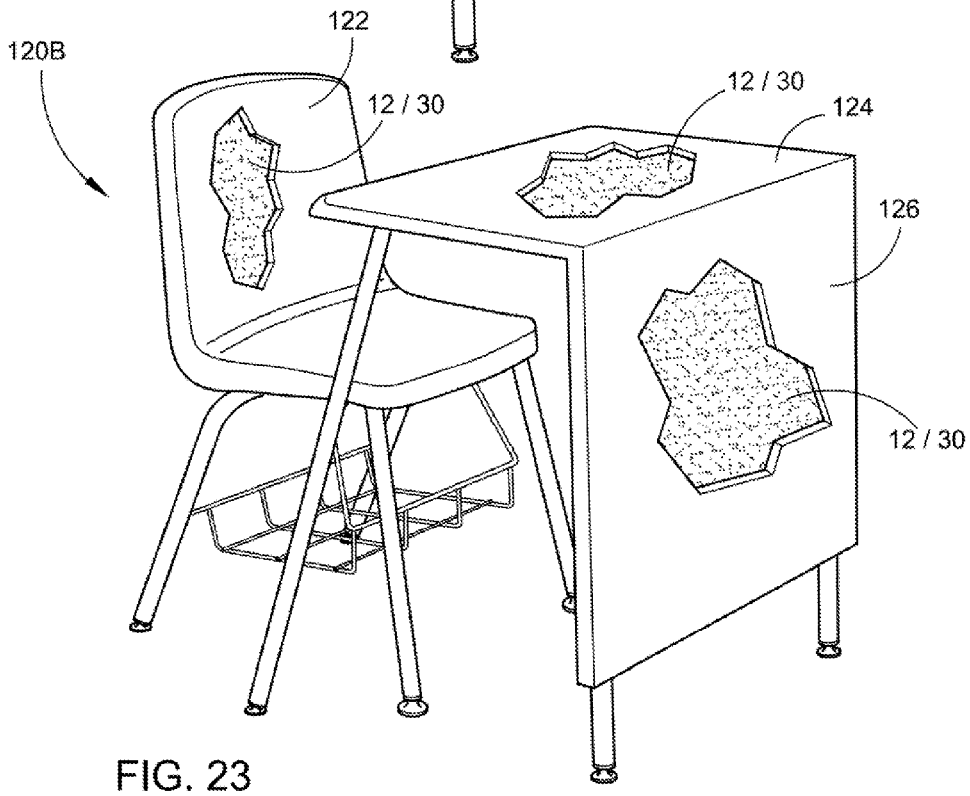
FIG. 23 depicts a school desk having a front panel with separate chair having Ballistic Defense Shielding.

FIG. 23 depicts a school desk 120B with separate chair 122 having an additional front panel 126 connected to the desk top 124 having Ballistic Defense Shielding consisting of soft armor 12 or hard armor 30.

Figure 24:
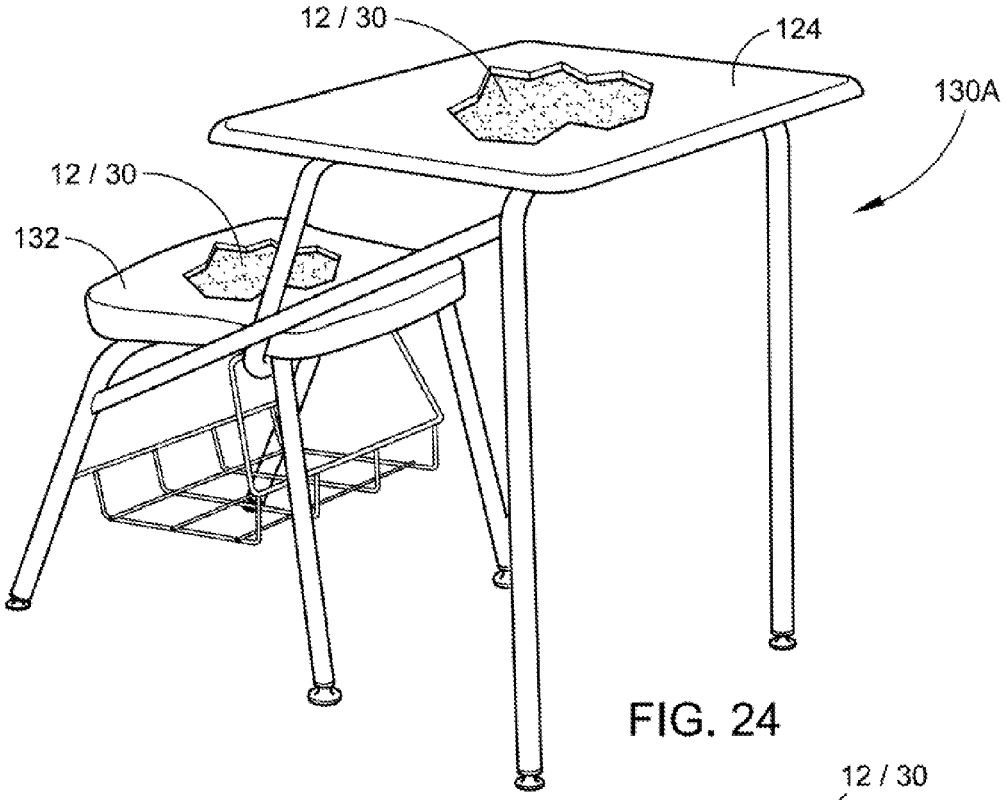
FIG. 24 depicts a school desk with attached stool having Ballistic Defense Shielding.

FIG. 24 depicts a school desk 130A with attached stool 132 having Ballistic Defense Shielding consisting of soft armor 12 or hard armor 30.

Figure 25:
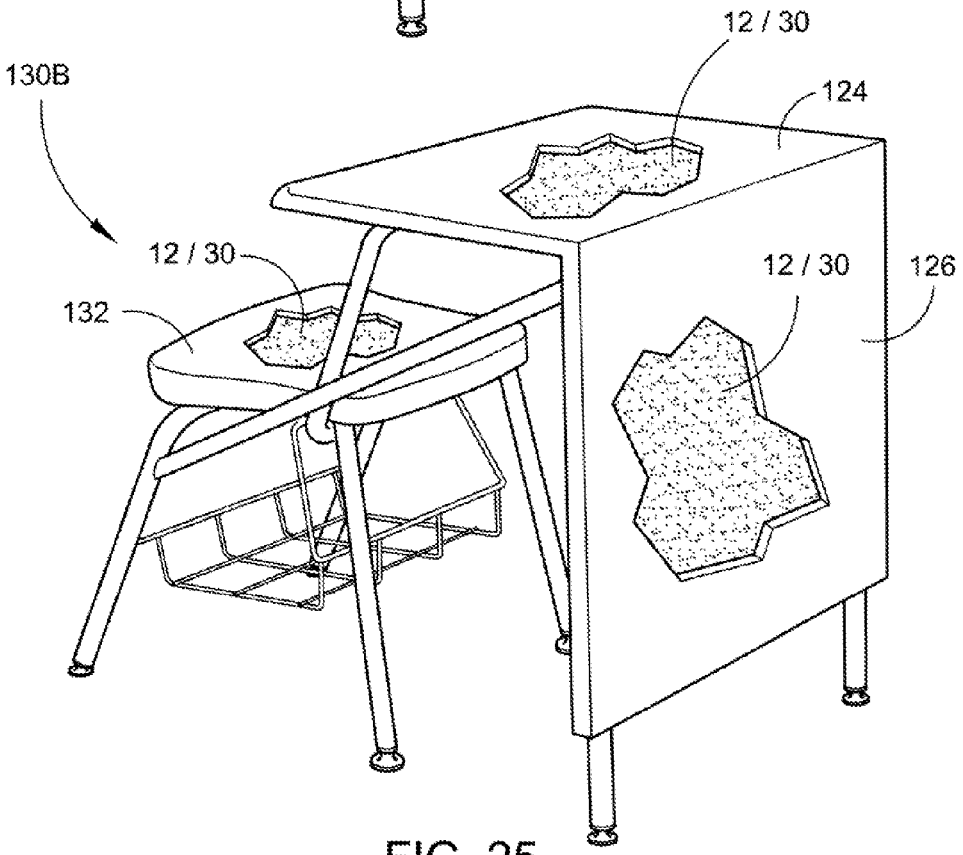
FIG. 25 depicts a school desk with a front panel and an attached stool having Ballistic Defense Shielding.

FIG. 25 depicts a school desk 130B with the addition of a front panel 126 connected to the desk top 124 and an attached stool 132 all having Ballistic Defense Shielding consisting of soft armor 12 or hard armor 30.

Figure 26:
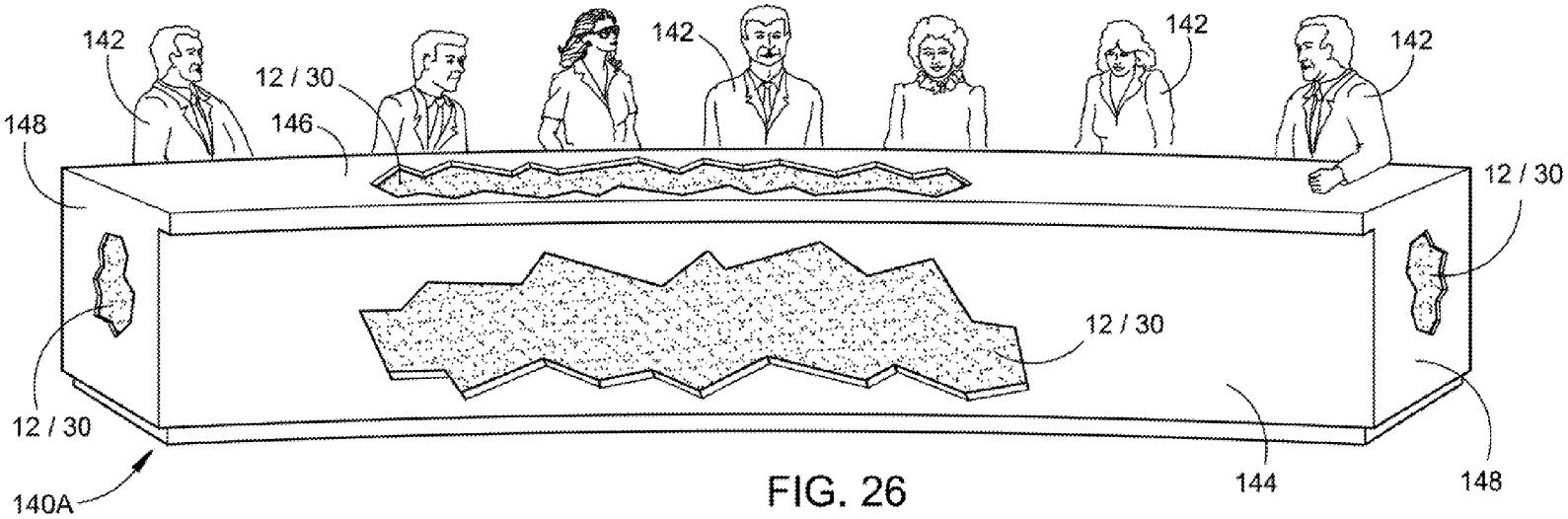
FIG. 26 depicts a governing panel of people seated at a one piece extended governing body bench with internal Ballistic Defense Shielding.

FIG. 26 depicts a governing panel of people 142 seated at a one piece governing body bench 140A with internal Ballistic Defense Shielding consisting of soft armor 12 or hard armor 30 on the front 144, top 146 and side 148 surfaces.

Figure 27:
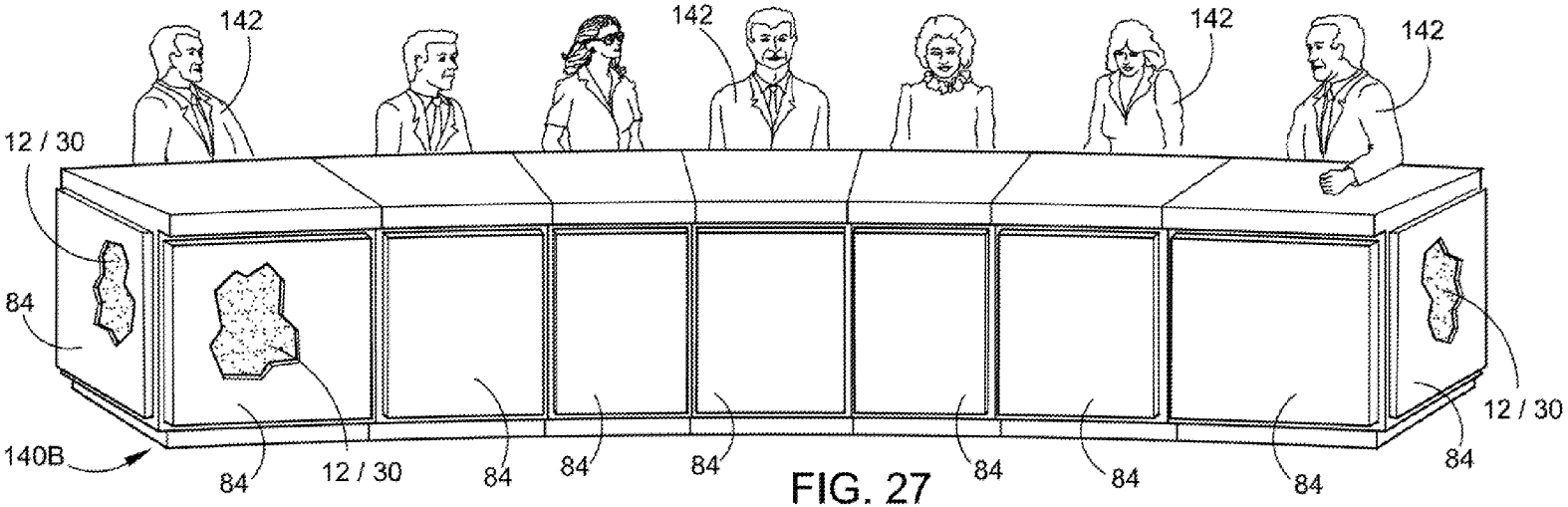
FIG. 27 depicts a governing panel of people seated at a segmented extended governing body bench with external retro-fit Ballistic Defense Shielding.

FIG. 27 depicts a governing panel of people 142 seated at a segmented governing body bench 140B with external retro-fit Ballistic Defense Shielding frames 84 having soft armor 12 or hard armor 30.

Figure 28:
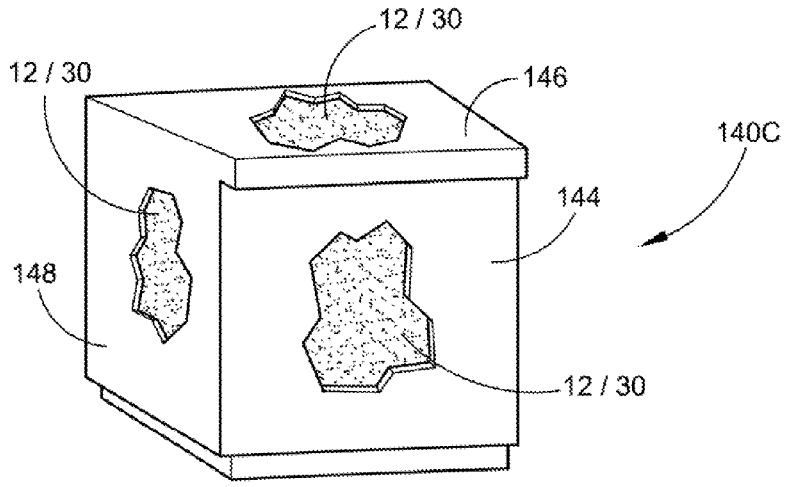
FIG. 28 depicts one segment of a governing body bench with internal Ballistic Defense Shielding.

FIG. 28 depicts one segment of a governing body bench 140C with internal Ballistic Defense Shielding having soft armor 12 or hard armor 30 on the front 144, top 146 and side 148 surfaces.

Figure 29:
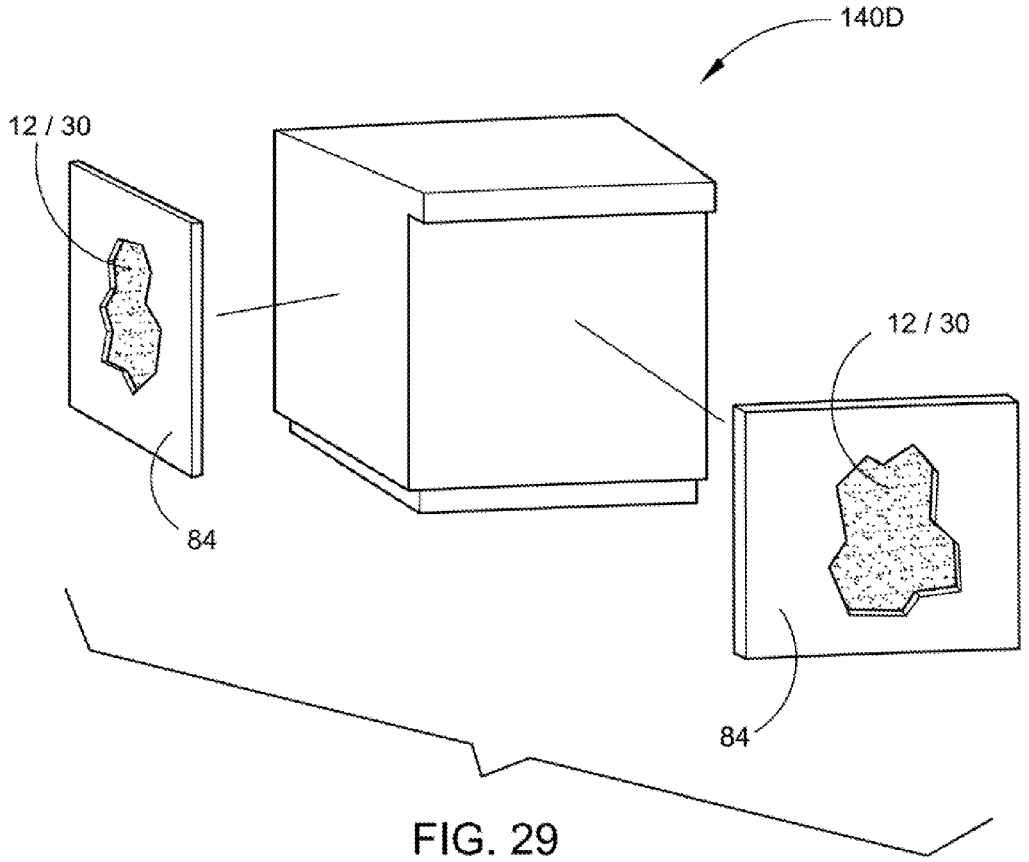
FIG. 29 depicts one segment of a governing body bench with external retro-fit Ballistic Defense Shielding.

FIG. 29 depicts one segment of a governing body bench 140D with external retro-fit Ballistic Defense Shielding frames 84 having soft armor 12 or hard armor 30 exploded away to be attached to the governing body bench 140D. If known to the public that anti-ballistic furniture is in use in such city council or school board meetings, it may act as a deterrent to a would-be perpetrator. For example, the shooter may seek a different target knowing that preventative measures have been taken to thwart shootings, in the form of having furniture providing ballistic defense shielding in an office, school or other facility.

The methods of manufacturing Furniture Providing Ballistic Defense Shielding 10A and 10B shown in the drawings and described in detail herein disclose arrangements of elements of particular construction and configuration for illustrating preferred embodiments of structure and method of manufacturing Furniture Providing Ballistic Defense Shielding. It is to be understood, however, that elements of different construction and configuration and other arrangements thereof, other than those illustrated and described may be employed for providing methods of manufacturing Furniture Providing Ballistic Defense Shielding 10A and 10B in accordance with the spirit of this application, and such changes, alternations and modifications as would occur to those skilled in the art are considered to be within the scope of this application as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the methods of manufacturing Furniture Providing Ballistic Defense Shielding of the application, measured by the claims, nor is it intended to be limiting as to the scope of the invention in any way.

We claim:

1. A piece of furniture initially constructed to be bullet-proof or bullet-resistant, comprising: a piece of furniture having one or more surfaces and ballistic defense shielding comprising: a frame; at least a first layer of anti-ballistic fabric comprising high strength synthetic fibers laid in a first direction; and at least a second layer of anti-ballistic fabric comprising high strength synthetic fibers laid in a second direction different from the first direction to form an armored surface, wherein the armored surface is attached substantially parallel and adjacent to the one or more surfaces of the piece of furniture.

2. The piece of furniture initially constructed to be bullet-proof or bullet-resistant according to claim 1, wherein said piece of furniture is a table and said ballistic defense shielding comprises soft armor.

3. The piece of furniture initially constructed to be bullet-proof or bullet-resistant according to claim 2, wherein said ballistic defense shielding comprises hard armor in place of soft armor.

4. The piece of furniture initially constructed to be bullet-proof or bullet-resistant according to claim 1, wherein said piece of furniture is a desk and said ballistic defense shielding comprises soft armor.

5. The piece of furniture initially constructed to be bullet-proof or bullet-resistant according to claim 4, wherein said ballistic defense shielding comprises hard armor in place of soft armor.

6. The piece of furniture initially constructed to be bullet-proof or bullet-resistant according to claim 1, wherein said piece of furniture is a podium and said ballistic defense shielding comprises soft armor.

7. The piece of furniture initially constructed to be bullet-proof or bullet-resistant according to claim 6, wherein said ballistic defense shielding comprises hard armor in place of soft armor.

8. The piece of furniture initially constructed to be bullet-proof or bullet-resistant according to claim 1, wherein said piece of furniture is a judicial bench and said ballistic defense shielding comprises soft armor.

9. The piece of furniture initially constructed to be bullet-proof or bullet-resistant according to claim 8, wherein said ballistic defense shielding comprises hard armor in place of soft armor.

10. The piece of furniture initially constructed to be bullet-proof or bullet-resistant according to claim 1, wherein said piece of furniture is a governing body bench and said ballistic defense shielding comprises soft armor.

11. The piece of furniture initially constructed to be bullet-proof or bullet-resistant according to claim 10, wherein said ballistic defense shielding comprises hard armor in place of soft armor.

* * * * *